US005667374A

United States Patent [19]

Nutcher et al.

[11] Patent Number: 5,667,374

[45] Date of Patent: Sep. 16, 1997

[54] PREMIX SINGLE STAGE LOW NOX BURNER

[75] Inventors: Peter B. Nutcher, Canonsburg; Peter J. Waldern, Bethel Park, both of Pa.

[73] Assignee: Process Combustion Corporation, Pittsburgh, Pa.

[21] Appl. No.: 962,280

[22] Filed: Oct. 16, 1992

[51] Int. Cl.[6] ..... F23D 3/40

[52] U.S. Cl. ..... 431/7; 431/328

[58] Field of Search ..... 431/328, 329, 431/7, 346; 239/552, 553.3, 554

[56] References Cited

U.S. PATENT DOCUMENTS

| | | | |
|---|---|---|---|
| 712,130 | 10/1902 | Gordon | 239/552 |
| 917,998 | 4/1909 | Buddington | 431/346 |
| 1,246,682 | 11/1917 | Thompson | 239/553.3 |
| 1,368,120 | 2/1921 | Cole | 431/346 |
| 1,372,724 | 3/1921 | Stine | 239/552 |
| 2,217,518 | 10/1940 | Merk | 431/115 |
| 2,518,544 | 8/1950 | Anthes | 239/553.3 |
| 3,544,255 | 12/1970 | Roper | 431/347 |
| 3,561,902 | 2/1971 | Best | 431/328 |
| 3,751,213 | 8/1973 | Sowards | 431/328 |
| 3,787,169 | 1/1974 | Gierde | 431/347 |
| 4,421,476 | 12/1983 | Gulden et al. | 431/328 |
| 4,701,123 | 10/1987 | Tallman et al. | 431/350 |
| 4,752,213 | 6/1988 | Grochowski et al. | 431/328 |
| 5,026,273 | 6/1991 | Cornelison | 431/328 |

FOREIGN PATENT DOCUMENTS

| | | |
|---|---|---|
| 52-14224 | 2/1977 | Japan . |
| 59-153017 | 8/1984 | Japan . |
| 62-142915 | 6/1987 | Japan . |
| 1262334 | 2/1972 | United Kingdom . |
| 2054822 | 2/1981 | United Kingdom . |

*Primary Examiner*—Carroll B. Dority
*Attorney, Agent, or Firm*—Webb Ziesenheim Bruening Logsdon Orkin & Hanson, P.C.

[57] ABSTRACT

A premix burner has a mixing plenum, a mesh flametrap and a ceramic honeycomb arranged in series. The mixing plenum has inner and outer chambers, with a mixing nozzle for introducing a gaseous fuel concentrically located in the inner chamber. The burner is operated with either high excess air or flue gas recirculation to produce a low temperature flame at a flame face defined by the honeycomb. The thorough premixing of air and fuel ensures a flame with homogeneous air-to-fuel ratios across the flame face, producing low NOx levels. The honeycomb and flametrap also function as flame arrestors to prevent burner flashback. A method for attaining a low temperature, low NOx flame using excess air, with or without flue gas recirculation, is also disclosed.

17 Claims, 1 Drawing Sheet

PREMIX SINGLE STAGE LOW NOX BURNER

BACKGROUND OF THE INVENTION

1. Field of the Invention

This application relates to combustion of gaseous fuels in a manner which meets today's pollution requirements and, more particularly, to a burner and method for producing a low temperature flame utilizing excess combustion air or flue gas recirculation.

2. Description of the Prior Art

Nitrogen oxide (NOx) emission regulations applied to combustion processes are becoming increasingly more stringent. Benchmarks for these regulations are frequently set by the Southern California Air Quality Management District ("SCAQMD"), which has promulgated regulations that would limit the NOx emissions from burners operating with natural gas to less than 25 parts per million on a volume basis ("ppmv"), corrected to 3% oxygen. Other states have enacted or are contemplating similar legislation.

All combustion reactions produce NOx via one of two mechanisms. Thermal NOx is produced in high temperature flames by fixation from nitrogen and oxygen present in the combustion air. Fuel NOx is produced from chemically bound nitrogen present in the fuel combusted. Depending on the nitrogen concentration present, fuel NOx generation rates can be orders of magnitude greater than thermal NOx generation rates. This invention is directed to reducing thermal NOx only. The generally accepted mechanism of thermal NOx formation is described by the following reaction equations:

$$N_2+O \leftrightharpoons NO+N \quad (1)$$

$$O_2+NO \leftrightharpoons O \quad (2)$$

The forward reaction rate constant for reaction (2) is much larger than the corresponding rate constant for the forward reaction of equation (1). Therefore, a cursory analysis might lead to the conclusion that reaction (2) is the dominant reaction producing NOx.

However, the concentrations of the species involved in the reactions must also be considered. The nitrogen and oxygen are produced by the thermal disassociation of $N_2$ and $O_2$ at elevated temperatures. Molecular nitrogen is thermally disassociated at a much slower rate than oxygen. This results in a large population of oxygen atoms early in the reaction while the nitrogen atom population remains relatively small. This high concentration of oxygen relative to nitrogen is sufficient to offset the disparity in rate constants between reactions (1) and (2).

Reducing the peak flame temperature in a burner is a well established method of reducing the NOx generation rate. Tests have confirmed a direct relationship between equilibrium oxygen mole fractions and equilibrium NO mole fractions present in the reactions taking place during combustion of natural gas. It has been established that equilibrium oxygen mole fractions are much lower below 2500° F., with the consequence that NO mole fractions are also lower below this temperature.

There are two possible methods of reducing flame temperature in a burner. One extracts radiant heat from the flame by transfer to cooled surfaces surrounding the flame. There are practical limitations to this technique, however. The loss of heat radiation from the center of the flame will be screened by the gases surrounding the center. The outermost gases successfully radiate their heat to the cooled surfaces, but the central gases only radiate to the gases immediately surrounding them. Therefore, the reduction in maximum flame temperature is not uniform and ineffective.

The second method of reducing the flame temperature is by introducing a sensible heat load to lower the temperature. This is the principle behind flue gas recirculation, which also reduces the oxygen concentration in the flame envelope. The flame temperature will also be moderated by using high excess air levels.

Prior efforts to achieve low flame temperatures and reduced NOx levels have exposed several problems. Particularly, it can be difficult to maintain stable combustion near the lower flammability limit of a given fuel when the flame temperature is low. Additionally, flameouts and high carbon monoxide emission levels can occur. It has been found that almost perfect mixing of fuel and oxygen prior to combustion is essential to achieving the lowest NOx levels without these problems, particularly using single stage burners. The problem of burner flashback becomes a consideration when fuel and oxygen are premixed before ignition.

Therefore, it is an object of the present invention to minimize thermal NOx generation when combusting fuels which contain negligible amounts of fuel bound nitrogen. It is a further object to provide a burner and method which maintains stable combustion at low flame temperatures, and provides accurate mixing of fuel and oxygen in the flame to avoid flameouts and high carbon monoxide emissions. Finally, it is an object of the invention to provide a premix burner and method which meets today's stringent NOx standards, while eliminating the problem of burner flashback.

SUMMARY OF THE INVENTION

Accordingly, we have invented a burner for producing a low temperature flame having a mixing plenum, a mesh flametrap adjacent the mixing plenum and a honeycomb downstream of the flametrap. The honeycomb has a plurality of axial passages therethrough, and the honeycomb defines a planar flame face at the downstream end of the burner. Fuel and excess air, with or without flue gases, are introduced to the mixing plenum where thorough mixing takes place. The air/fuel mixture passes through the mesh flametrap and enters the honeycomb passages. Preferably, the mesh flametrap abuts the honeycomb. Upon exiting the passages, the air/fuel mixture is ignited at the flame face to produce a low temperature flame. The flame achieved is substantially homogeneous, due to the thorough premixing of air and fuel. The low flame temperature achieved using excess air or flue gas recirculation, combined with the thorough mixing provided by the burner structure, affords attainment of extremely low NOx levels in a single stage burner, along with low carbon monoxide levels, excellent flame stability and minimal flashback problems.

The burner may also include a flame stabilizer adjacent the flame face to create turbulence and to hold the flame near the flame face. A mixing nozzle may extend into the mixing plenum for introducing the gaseous fuel to the mixing plenum. Finally, the burner may include an outer plenum and a concentric inner plenum in communication with the outer plenum. The fuel nozzle may be concentrically disposed in the inner plenum.

The invention also includes a method for producing a low temperature flame in a burner, such as the one described above. The method may include introducing combustion air to the plenum in an amount equal to or greater than 180% of the stoichiometric amount required. Alternatively, combustion air in lesser amounts may be vitiated with flue gas and introduced to the plenum.

Other details and advantages of the invention will become apparent from the following description in conjunction with the accompanying drawings.

DETAILED DESCRIPTION OF THE PREFERRED EMBODIMENT

Figure 1:
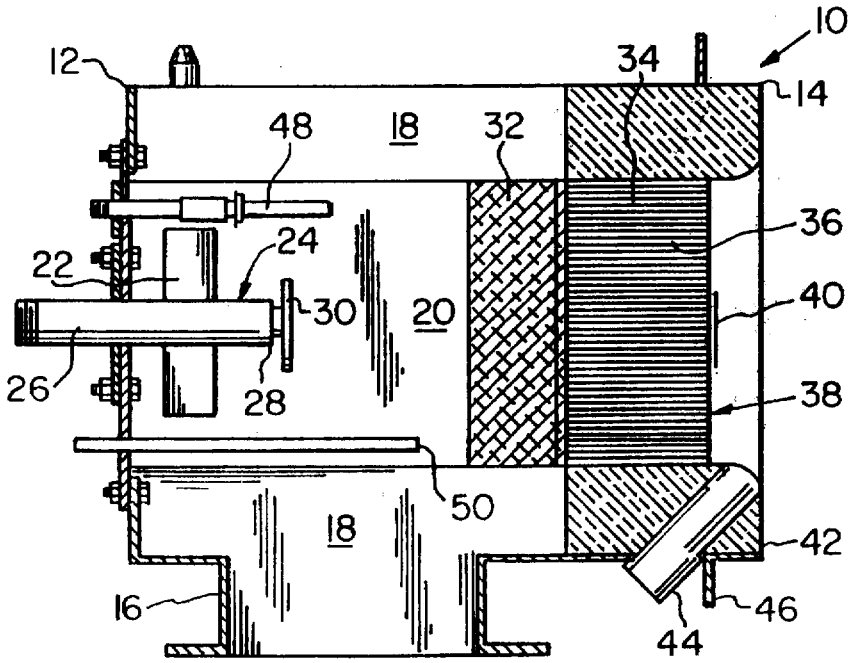
FIG. 1 is a cross section of a burner in accordance with the present invention.

FIG. 1 shows a burner 10 having an upstream end 12 and a downstream end 14, according to the present invention. The burner has an air intake 16 near upstream end 12 and the air intake feeds into an outer plenum 18. A concentric inner plenum 20 is in communication with the outer plenum 18 via a plurality of apertures 22 adjacent the upstream end of inner plenum 20.

A mixing nozzle 24 is concentrically disposed in inner plenum 20 for introducing a gaseous fuel to the inner plenum. The mixing nozzle includes a fuel tube 26 having an outlet 28. A blank or apertured bluff body 30 is mounted on outlet 28 for creating turbulence at the point of introduction of gaseous fuel into the inner plenum 20.

A stainless steel mesh flametrap 32 is adjacent inner plenum 20 and in direct communication therewith. Approximately 33% of the cross-sectional area of the mesh is open to fluid flow. The outer dimensions of the flametrap are coterminous with those of the inner plenum 20.

Abutting the flametrap and immediately downstream thereof is a ceramic honeycomb 34 having a plurality of axial passageways 36 therethrough. The honeycomb defines a planar flame face 38 at the downstream end 14 of burner 10. The honeycomb may be constructed from a plurality of modular units stacked to meet the desired dimensions of the burner 10. The honeycomb 34 preferably has 300 passageways per square inch. To facilitate scale-up, the burner itself may be designed in basic smaller modules which can be fitted together in multiples to form larger sizes.

A flame stabilizer 40 is centrally mounted on flame face 38. The flame stabilizer 40 is basically a flat plate which creates turbulence at the flame face 38, drawing the flame towards the plate to stabilize the flame and keep it near the flame face.

A refractory ring 42 surrounds honeycomb 34 and includes a connection 44 for a pilot to extend through the ring adjacent flame face 38. A mounting flange 46 extends outwardly from the ring 42. The inner plenum contains a flame detector 48 for indicating whether burner flashback occurs. A pressure monitor 50 is also disposed in inner plenum 20 to measure static pressure at the downstream end of the inner plenum.

For operation with the excess air method, air in excess of the stoichiometric amount needed to complete the combustion reaction with the given fuel is introduced to air intake 16 by a fan or other suitable means. Preferably, the amount of combustion air is 80–100% in excess of the theoretical stoichiometric amount. Most preferably, the air is 100% in excess of that amount. Below 80%, the target NOx values have not been achieved. Over 110%, excessive carbon monoxide levels have been encountered.

Figure 2:
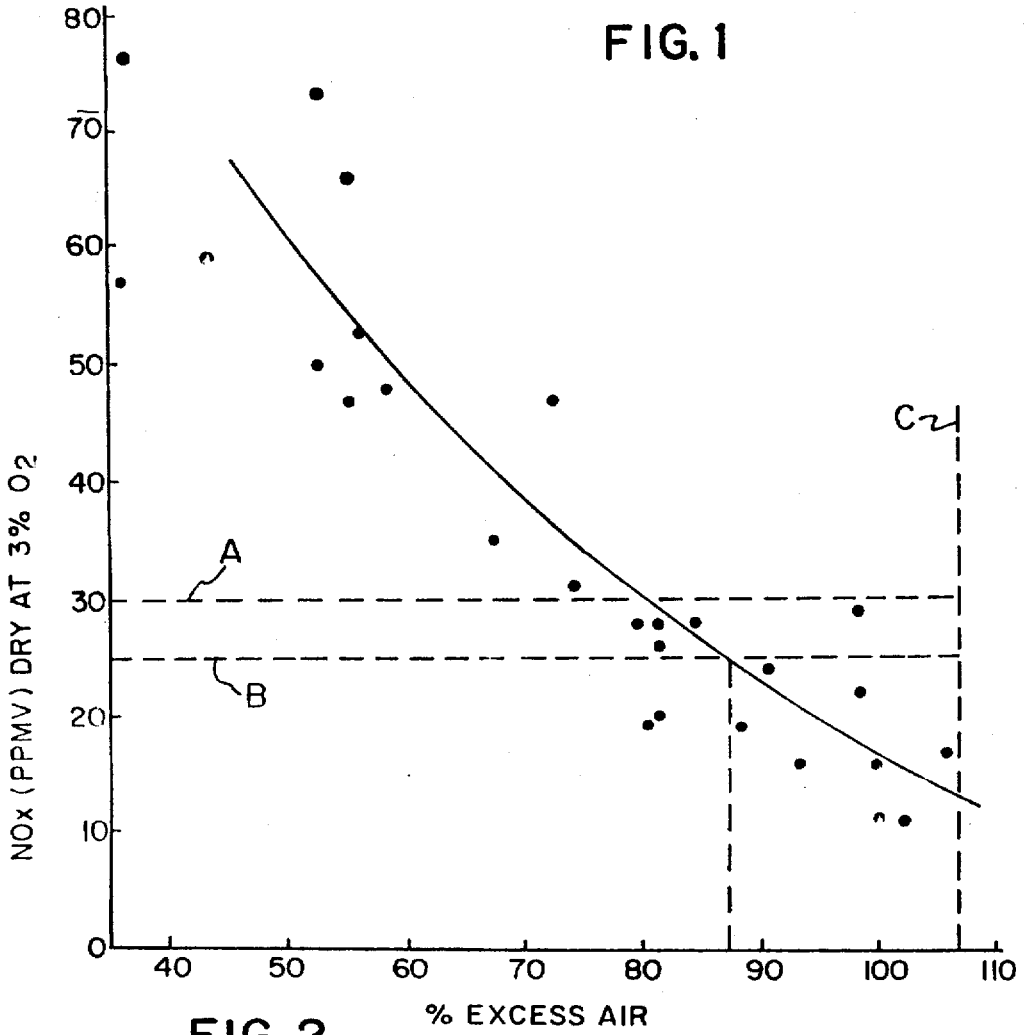
FIG. 2 is a graphic illustration of actual test results utilizing the burner of the present invention, showing a plot of NOx production versus the percent of excess combustion air utilized in the burner.

Actual tests with a prototype of a burner in accordance with the present invention yielded the results set forth in FIG. 2. These results confirmed the above limitations on the amount of excess air which should be utilized. Particularly, line A represents the rules enforced by SCAQMD with respect to NOx production by burners such as the burner of the present invention. Line B represents the target NOx level for the present invention. Line C delineates the maximum excess air which can be utilized before unacceptable amounts of carbon monoxide are produced.

The air enters outer plenum 18 and proceeds through apertures 22 into inner plenum 20. Gaseous fuel is introduced to inner plenum 20 through mixing nozzle 24. The bluff body 30 on the end of mixing nozzle 24 causes turbulence in both the incoming air and gaseous fuel to promote intermixing of the two. Note that the gaseous fuel should contain little or no nitrogen for proper operation of the burner and method of the present invention.

The air/fuel mixture proceeds through mesh flametrap 32 directly downstream of inner plenum 20. The tortuous path through mesh flametrap 32 further commingles the air and fuel to enhance mixing. Immediately following mesh flametrap 32, the mixture enters the several axial passageways 36 in honeycomb 34 and exits the honeycomb as a plurality of finely divided streams. Due to thorough premixing, each stream has substantially the same air to fuel ratio.

The multitude of streams ignite at flame face 38 to produce a homogeneous, well mixed flame having a low temperature. Table 1 below displays the adiabatic flame temperatures achieved with various amounts of excess combustion air.

TABLE I

ADIABATIC FLAME TEMPERATURE VS. EXCESS AIR

| % Excess Air | Temperature (Degrees F.) |
|---|---|
| 15 | 3309 |
| 25 | 3129 |
| 50 | 2738 |
| 75 | 2437 |
| 100 | 2201 |
| 110 | 2120 |

The values in FIG. 2 confirm that target NOx levels may be achieved utilizing 80 to 110% excess air with the burner of the present invention.

Burning with excess air is particularly suitable for direct drying applications, for example in the food and beverage industry, tissue and detergent manufacture, chemicals and kaolin.

Flame temperatures low enough to meet target NOx levels may also be achieved utilizing flue gas recirculation. In this method, combustion air in a lesser amount is introduced to outer plenum 18 through air intake 16. Combustion air in an amount which is 10% in excess of the theoretical stoichiometric amount has been found suitable for this purpose. Typically, the combustion air is pre-vitiated with an appropriate amount of recirculated flue gas upstream of air intake 16 by means well known in the art. As a guideline, the amount of excess air and recirculated flue gas should be controlled to produce less than 3% excess oxygen levels in the products of combustion. The vitiated combustion air is then mixed with gaseous fuel before proceeding through the burner as described above in connection with burning excess air.

Burning with vitiated combustion air using flue gas recirculation is particularly suitable for fired heat transfer applications, for example, boilers, fluid heaters, pipestill furnaces and incinerators.

Actual prototype tests of a burner according to the present invention yielded the following observations:

1. The burner is stable over a wide range of firing rates and excess air levels (80–100%).
2. The burner did not show a propensity to flashback.
3. At excess air rates greater than 90%, NOx levels are less than 25 ppmv, dry, corrected to 3% oxygen.
4. Burner turndown is greater than 4 to 1.
5. The flame is very blue, burning brightly.

The prominence of the blue flame indicates full aeration of the fuel and thorough mixing.

6. Low NOx emissions were achieved using high excess air at all firing rates.
7. Beyond approximately 110% excess air, carbon monoxide levels increased dramatically.
8. Burner operation was very smooth and quiet, igniting easily at high excess air rates in a cold furnace.

The burner of the present invention achieves low NOx levels heretofore unattainable with single stage burners, even at low flame temperatures. The low NOx levels are attributed to thorough mixing provided by the premix, providing homogeneous air to fuel ratios throughout the flame.

Having described the presently preferred embodiment of the invention, it will be understood that it is not intended to limit the invention except within the scope of the following claims.

We claim:

1. A single stage low NOx burner for producing a low temperature flame, comprising:

a mixing plenum;

a mesh flametrap adjacent said mixing plenum;

a honeycomb downstream of and abutting said flametrap, said honeycomb having a plurality of axial passages therethrough, said honeycomb further defining a planar flame face at a downstream end of said burner, wherein said honeycomb is positioned between said planar flame face and said mesh flametrap;

wherein gaseous fuel and excess air, with or without flue gas, are introduced to said mixing plenum, pass through said mesh flametrap and exit the passages of said honeycomb at said flame face where they are ignited to produce a low temperature flame;

means for supplying air to said mixing plenum, a mixing nozzle extending into said mixing plenum for introducing the gaseous fuel to and a bluff body mounted in front of said mixing nozzle for deflecting gaseous fuel laterally into said air.

2. A single stage low NOx burner for producing a low temperature flame, comprising:

a mixing plenum;

a mesh flametrap adjacent said mixing plenum;

a honeycomb downstream of and abutting said flametrap, said honeycomb having a plurality of axial passages therethrough, said honeycomb further defining a planar flame face at a downstream end of said burner; and a flame stabilizer adjacent said flame face;

wherein gaseous fuel and excess air, with or without flue gas, are introduced to said mixing plenum, pass through said mesh flametrap, and exit the passages of said honeycomb at said flame face where they are ignited to produce a low temperature flame.

3. A single stage low NOx burner for producing a low temperature flame, comprising:

a mixing plenum, wherein said mixing plenum includes an outer plenum and a concentric inner plenum in communication with said outer plenum with a fuel nozzle coaxially disposed in said inner plenum;

a mesh flametrap adjacent said mixing plenum; and a honeycomb downstream of and abutting said flametrap, said honeycomb having a plurality of axial passages therethrough, said honeycomb further defining a planar flame face at the downstream end of said burner;

wherein gaseous fuel and excess air, with or without flue gas, are introduced to said mixing plenum, pass through said mesh flametrap and exit the passages of said honeycomb at said flame face where they are ignited to produce a low temperature flame.

4. The burner of claim 1 including an annular refractory ring surrounding said honeycomb.

5. A method for producing a low temperature flame in a single stage low NOx burner comprising the steps of:

a) introducing combustion air and a gaseous fuel to a plenum, with the amount of combustion air being in excess of a stoichiometric amount required to complete a combustion reaction with said fuel, said fuel introduced to said plenum through a mixing nozzle and deflecting said fuel laterally into said air to create turbulence and enhance mixing in said plenum;

b) mixing said air and fuel in said plenum;

c) passing the air/fuel mixture through a mesh flametrap;

d) immediately thereafter passing the entire air/fuel mixture through a honeycomb abutting said flametrap and having a plurality of axial passageways, said air/fuel mixture exiting the passageways as a plurality of finely divided streams; and e) igniting said air/fuel mixture at a flame face defined by the terminus of said passageways to produce a low temperature flame.

6. The method of claim 5 including the step of introducing flue gas to said plenum.

7. The method of claim 5 wherein said combustion air is vitiated with flue gas prior to said air being introduced to said plenum.

8. The method of claim 5 wherein combustion air is introduced to said plenum in an amount which is up to 110% in excess of the stoichiometric amount.

9. A method for producing a low temperature flame in a single stage low NOx burner, comprising the steps of:

a) introducing combustion air and a gaseous fuel to a plenum, with the amount of combustion air being in excess of a stoichiometric amount required to complete a combustion reaction with said fuel, wherein said excess air is introduced to an outer plenum and said fuel is introduced to a concentric inner plenum, said air passed to said inner plenum through a plurality of annular openings in an upstream portion of said inner plenum;

b) mixing said air and fuel in said plenum;

c) passing the air/fuel mixture through a mesh flametrap;

d) immediately thereafter passing the entire air/fuel mixture through a honeycomb abutting said mesh flametrap and having a plurality of axial passageways, said air/fuel mixture exiting the passageways as a plurality of finely divided streams; and e) igniting said air/fuel mixture at a flame face defined by the terminus of said passageways to produce a low temperature flame.

10. The burner of claim 2 further including a mixing nozzle extending into said mixing plenum for introducing the gaseous fuel to said mixing plenum.

11. The burner of claim 2 wherein said mixing plenum includes an outer plenum and a concentric inner plenum in communication with said outer plenum with a fuel nozzle concentrically disposed in said inner plenum.

12. The burner of claim 2 further including an annular refractory ring surrounding said honeycomb.

13. The burner of claim 3 further including a flame stabilizer adjacent said flame face.

14. The burner of claim 3 further including an annular refractory ring surrounding said honeycomb.

15. The method of claim 13 wherein combustion air is introduced to said plenum in an amount which is up to 110% in excess of the stoichiometric amount.

16. A method for producing a low temperature flame in a burner, comprising the steps of:

a) introducing combustion air, flue gas and a gaseous fuel to a plenum, with the amount of combustion air being in excess of a stoichiometric amount required to complete a combustion reaction with said fuel, said fuel introduced to said plenum through a mixing nozzle to create turbulence and enhance mixing in said plenum;

b) mixing said air and fuel in said plenum;

c) passing the air/fuel mixture through a mesh flametrap;

d) immediately thereafter passing the entire air/fuel mixture through a honeycomb having a plurality of axial passageways, said air/fuel mixture exiting the passageways as a plurality of finely divided streams; and e) igniting said air/fuel mixture at a flame face defined by the terminus of said passageways to produce a low temperature flame.

17. A method for producing a low temperature flame in a burner, comprising the steps of:

a) introducing combustion air and a gaseous fuel to a plenum, wherein the combustion air is vitiated with flue gas prior to said air being introduced to said plenum, with the amount of combustion air being in excess of a stoichiometric amount required to complete a combustion reaction with said fuel, said fuel introduced to said plenum through a mixing nozzle to create turbulence and enhance mixing in said plenum;

b) mixing said air and fuel in said plenum;

c) passing the air/fuel mixture through a mesh flametrap;

d) immediately thereafter passing the entire air/fuel mixture through a honeycomb having a plurality of axial passageways, said air/fuel mixture exiting the passageways as a plurality of finely divided streams; and e) igniting said air/fuel mixture at a flame face defined by the terminus of said passageways to produce a low temperature flame.

* * * * *

UNITED STATES PATENT AND TRADEMARK OFFICE

CERTIFICATE OF CORRECTION

PATENT NO. : 5,667,374

DATED : September 16, 1997

INVENTOR(S) : Peter B. Nutcher and Peter J. Waldern

It is certified that error appears in the above-identified patent and that said Letters Patent is hereby corrected as shown below:

Title Page, [56] References Cited, U.S. PATENT DOCUMENTS, insert:

| | | | |
|---|---|---|---|
| --3,155,142 | 11/1964 | Stack | 158/99 |
| 1,868,708 | 7/1932 | Hunt | |
| 2,582,577 | 1/1952 | Zink et al. | 158/110 |
| 4,090,839 | 5/1978 | von Linde et al. | 431/89--. |

Column 1 Line 36, Equation (2), "$O_2$+NO↔O" should read --$O_2$+N↔NO+O--.

Column 3 Line 63 "80-100" should read --80-110%--.

Column 5 Line 6 "(80-100%)" should read --(80-110%)--.

Claim 1 Column 5 Line 50 after "gaseous fuel to" insert --said mixing plenum , --.

Claim 15 Column 7 Line 14 "method of claim 13" should read --method of claim 9--.

Signed and Sealed this

Thirtieth Day of December, 1997

*Attest:*

*Attesting Officer*

BRUCE LEHMAN

*Commissioner of Patents and Trademarks*